US008132423B2

(12) United States Patent
Tikhonov et al.

(10) Patent No.: US 8,132,423 B2
(45) Date of Patent: Mar. 13, 2012

(54) REFRIGERATOR WITH SELECTIVE AIRFLOW PASSAGES BETWEEN THE ICEMAKER AND THE ICE MAKING EVAPORATOR

(75) Inventors: Alexei Tikhonov, Suwon-si (KR); June Kee Min, Seongnam-si (KR); Chang-Hak Lim, Hwasung-si (KR); Won Jae Yoon, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 411 days.

(21) Appl. No.: 11/987,581

(22) Filed: Nov. 30, 2007

(65) Prior Publication Data

US 2008/0127670 A1 Jun. 5, 2008

(30) Foreign Application Priority Data

Dec. 1, 2006 (KR) ..... 10-2006-0120685

(51) Int. Cl.
*F25D 17/04* (2006.01)
*F25D 11/02* (2006.01)
*F25C 1/00* (2006.01)

(52) U.S. Cl. ..... 62/340; 62/441; 62/407

(58) Field of Classification Search ..... 62/344, 62/353, 340, 186, 187, 420
See application file for complete search history.

(56) References Cited

U.S. PATENT DOCUMENTS

| | | | | |
|---|---|---|---|---|
| 7,076,967 | B2 * | 7/2006 | Lee et al. | 62/353 |
| 2003/0126881 | A1 | 7/2003 | Lee et al. | |
| 2004/0237565 | A1 * | 12/2004 | Lee et al. | 62/344 |
| 2005/0210909 | A1 * | 9/2005 | Kim et al. | 62/340 |

FOREIGN PATENT DOCUMENTS

| | | |
|---|---|---|
| EP | 1 517 103 | 3/2005 |
| EP | 1 598 618 | 11/2005 |
| KR | 10-2005-0028657 | 3/2005 |
| WO | 2006/067735 | 6/2006 |

OTHER PUBLICATIONS

European Search Report issue on the European Application No. 07121518.0-2301.

* cited by examiner

*Primary Examiner* — Frantz F Jules
*Assistant Examiner* — Cassey Bauer
(74) *Attorney, Agent, or Firm* — Staas & Halsey LLP

(57) ABSTRACT

Disclosed is a refrigerator having an ice making apparatus installed at a cooling chamber door that opens/closes a cooling chamber. The refrigerator includes a body having a cooling chamber therein, a cooling chamber door to open/close the cooling chamber, and an ice making apparatus installed in the cooling chamber door to make ice. An ice making evaporator is provided in the ice making apparatus to independently supply the ice making apparatus with cooling air and an ice making evaporator chamber, in which an ice making evaporator is installed, is provided adjacent to the cooling chamber door while being partitioned from the cooling chamber.

24 Claims, 4 Drawing Sheets

REFRIGERATOR WITH SELECTIVE AIRFLOW PASSAGES BETWEEN THE ICEMAKER AND THE ICE MAKING EVAPORATOR

CROSS-REFERENCE TO RELATED APPLICATIONS

This application claims the benefit of Korean Patent Application No. 10-2006-120685, filed on Dec. 1, 2006, in the Korean Intellectual Property Office, the disclosure of which is incorporated herein by reference.

BACKGROUND

1. Field

The present invention relates generally to a refrigerator, and more particularly, to a refrigerator having an ice making apparatus installed at a door of a cooling chamber.

2. Description of the Related Art

In general, a refrigerator is designed to supply cooling air generated through a refrigeration cycle to a cooling chamber and a freezing chamber so as to keep various foodstuffs in a cooled or frozen state, and includes a body forming the cooling chamber and the freezing chamber, a cooling chamber door and a freezing chamber door to open/close the cooling chamber and the freezing chamber, respectively, an ice making apparatus for making ice, and a dispenser allowing a user to take out water or ice.

Recently, among such refrigerators, as disclosed in Korean Patent No. 10-565621, there is a refrigerator in which a cooling chamber which is frequently used is disposed above a freezing chamber for the sake of convenience, and a dispenser is installed at a cooling chamber door that opens/closes the cooling chamber.

In this conventional refrigerator, an ice making apparatus is installed at the cooling chamber door to allow a user to readily take out the ice made by the ice making apparatus through a dispenser, and a body is provided at both sidewalls thereof with ducts to transfer the cooling air generated from the freezing chamber to the ice making apparatus arranged in the cooling chamber door.

However, since such a conventional refrigerator is inevitably subject to pressure loss due to flow resistance while the cooling air is moving along the duct provided at both sidewalls of the body, the amount of cooling air transferred to the ice making apparatus is insufficient, so that the ice making is not efficient.

SUMMARY

Accordingly, it is an aspect of the present invention to solve the above-mentioned problems occurring in the related art. Another aspect of the present invention is to provide a refrigerator capable of efficiently supplying cooling air to an ice making apparatus installed at the cooling chamber door.

Additional aspects and/or advantages will be set forth in part in the description which follows and, in part, will be apparent from the description, or may be learned by practice of the invention.

The foregoing and/or other aspects of the present invention are achieved by providing a refrigerator comprising a body having a cooling chamber defined therein, a cooling chamber door opening/closing the cooling chamber, an ice making apparatus making ice, an ice making evaporator supplying the ice making apparatus with cooling air, an ice making chamber provided at the cooling chamber door to install the ice making apparatus therein, and an ice making evaporator chamber defined in one side of the cooling chamber to receive the ice making evaporator therein while being partitioned from the cooling chamber and communicating with the ice making chamber when the cooling chamber has been closed by the cooling chamber door.

The ice making chamber is provided at both sides thereof with the pair of first through holes communicating with the ice making evaporator chamber, and the ice making evaporator chamber is provided with the pair of second through holes disposed corresponding to the first through holes to communicate with the first through holes when the cooling chamber has been closed by the cooling chamber door.

One of the first through holes is provided with the connection tube that enters the second through hole when the cooling chamber is closed by the cooling chamber door.

The connection tube is provided with the first damper rotatably installed in the connection tube to open the connection tube when the cooling chamber is closed by the cooling chamber door.

The connection tube is provided at an external side thereof with the guide bar having a predetermined length, in which one end of the guide bar is coupled to the first damper to be rotated together with the first damper, and the second through hole is provided at one side thereof with the guide protrusion protruding toward the connection tube to rotate the guide bar when the connection tube enters the connection tube.

The second through hole is provided with the second damper that is rotatably installed in the second through hole so as to open the second through hole when the connection tube enters the second through hole.

An upper end portion of the second damper is rotatably provided on an upper surface of the second through hole, and the connection tube is a front lower portion of the connection tube protruding toward the second through hole.

The ice making chamber is provided therein with the ice making circulation fan to generate a suction force and a blowing force such that the cooling air is circulated into the ice making chamber and the ice making evaporator chamber through the first through hole and the second through hole.

The cooling chamber door is provided with a dispenser that allows a user to take out the ice made by the ice making apparatus.

The foregoing and/or other aspects of the present invention are also achieved by providing a refrigerator comprising a body having a cooling chamber therein, a cooling chamber door opening/closing the cooling chamber, an ice making apparatus installed at the cooling chamber door to make ice, and an ice making evaporator that independently supplies the ice making apparatus with cooling air.

The cooling chamber door is provided with the ice making evaporator chamber in which the ice making evaporator is installed, and further comprising an ice making evaporator chamber, and an ice making chamber, wherein the body is provided with the ice making evaporator chamber, which is disposed at an upper front side of the cooling chamber while being partitioned from the cooling chamber and communicating with the ice making chamber.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
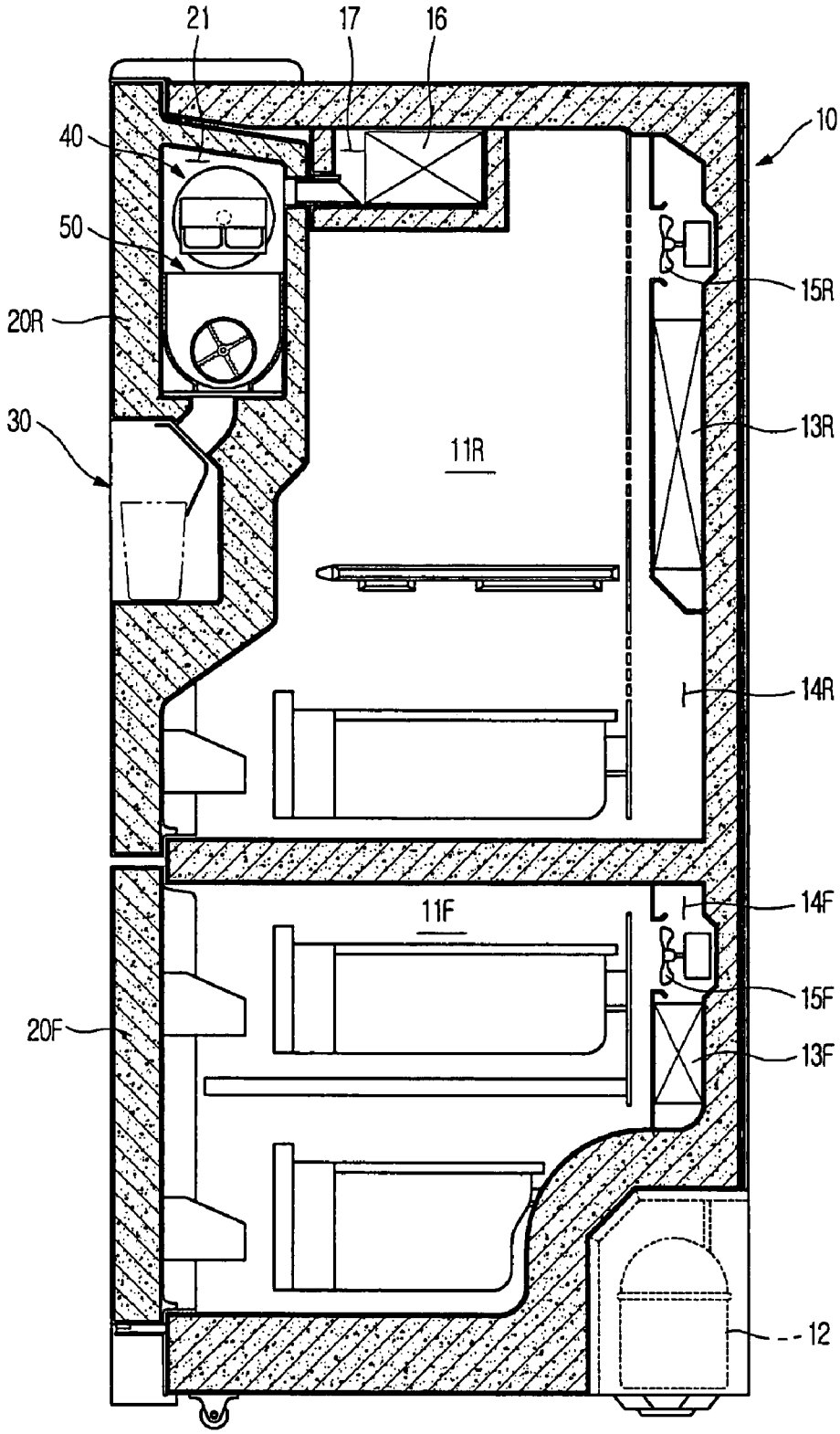
FIG. 1 is a side sectional view illustrating a refrigerator according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

As illustrated in FIG. 1, a refrigerator according to an embodiment of the present invention includes a body 10 provided with storage chambers 11R and 11F therein to store foodstuffs, and doors 20R and 20F hinged to one side of the body 10 to open/close the storage chambers 11R and 11F, respectively.

The storage chambers 11R and 11F are partitioned into upper and lower parts by an intermediate partition in such a manner that the upper part constitutes the cooling chamber 11R to keep foodstuffs cool and the lower part constitutes the freezing chamber 11F to keep foodstuffs frozen. The doors 20R and 20F include a cooling chamber door 20R to open/close the cooling chamber 11R and a freezing chamber door 20F to open/close the freezing chamber 11F, such that the cooling and freezing chambers 11R and 11F can be individually opened/closed.

The body 10 is provided at a lower rear side thereof with a compressor 12 to compress refrigerant, and the cooling and freezing chambers 11R and 11F are provided at rear portions thereof with cooling and freezing evaporator chambers 14R and 14F, which are partitioned from each other so as to accommodate cooling and freezing evaporators 13R and 13F, respectively, in order to generate cooing air to be supplied to the cooling and freezing chambers 11R and 11F. Further, the cooling and freezing evaporator chambers 14R and 14F are provided with a cooling circulation fan 15R and a freezing circulation fan 15F which rotate to generate suction force and blowing force allowing the cooling air generated from the cooling evaporator 13R and the freezing evaporator 13F to be circulated into the cooling and freezing chambers 11R and 11F, respectively.

The cooling chamber door 20R is provided with a dispenser 30 allowing the user to take out water or ice from the refrigerator without opening the cooling chamber door 20R, an ice making apparatus 40 capable of making ice so as to allow the user to take out the ice through the dispenser 30, and a transfer unit 50 transferring the ice made by the ice making apparatus 40 after storing the ice for a predetermined period of time such that the user can take out the ice through the dispenser 30 from the exterior. An ice making chamber 21 is provided to house the ice making apparatus 40 and the transfer unit 50 therein.

In addition, the refrigerator according to the embodiment of the present invention is provided with an ice making evaporator 16 that independently supplies the ice making apparatus 40 disposed in the cooling chamber door 20R with the cooling air. Also, an ice making evaporator chamber 17, in which the ice making evaporator 16 is installed, is provided at an upper front side of the cooling chamber 11R adjacent to the cooling chamber door 20R while being partitioned from the cooling chamber 11R.

Figure 2:
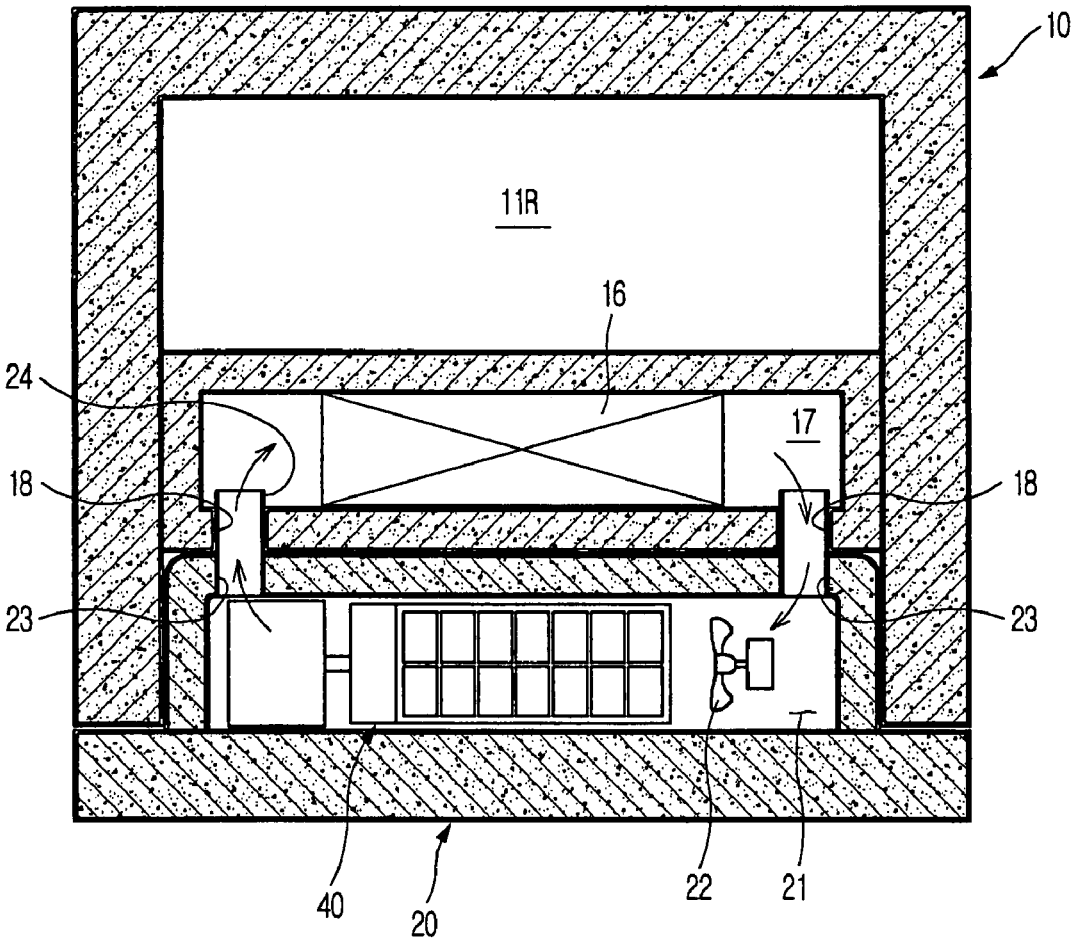
FIG. 2 is a plan sectional view illustrating the refrigerator according to FIG. 2.

In the present embodiment, the ice making evaporator chamber 17, as illustrated in FIG. 2, is communicated with the ice making chamber 21 so as to allow the cooling air to be circulated when the cooling chamber 11R is closed by the cooling chamber door 20R. The ice making chamber 21 is provided therein with an ice making circulation fan 22, which rotates to generate suction force and blowing force thereby allowing the cooling air to be circulated into the ice making chamber 21 and the ice making evaporator chamber 17.

In order to allow the ice making evaporator chamber 17 to communicate with the ice making chamber 21, a pair of first through holes 23 communicating with the ice making evaporator chamber 17 are provided at both sides of the ice making chamber 21, and a pair of second through holes 18 are disposed corresponding to the first through holes 23 so as to communicate with the first through holes 23 when the cooling chamber 11R is closed by the cooling chamber door 20R. Therefore, in a state in which the cooling chamber 11R is closed by the cooling chamber door 20R, when the ice making circulation fan 22 rotates to generate suction force and blowing force, the cooling air generated from the ice making evaporator chamber 17 is transferred to the ice making chamber 21 by way of the first through hole 23 and the second through hole 18 located at one side of the ice making chamber 21 so as to allow the ice making apparatus 40 to make ice, and then returns to the ice making evaporator chamber 17 by way of the first through hole 23 and the second through hole 18 located at the other side of the ice making chamber 21.

In addition, the first and second through holes 23 and 18 communicating with each other are opened when the user opens the cooling chamber door 20R to expose to the cooling chamber 11R. However, if the first through holes 23 have been opened, both the cooling air in the ice making evaporator chamber 17 and the cooling air in the ice making chamber 21 may leak into the interior of an indoor room, causing waste of the cooling air.

Therefore, in order to avoid the leakage of the cooling air through the first and second through holes 23 and 18 when the cooling chamber door 20R has been opened to expose to the cooling chamber 11R, the first through hole 23 is provided with a connection tube 24 which protrudes toward the second through hole 18 and enters the second through hole 18 when the cooling chamber 11R is closed by the cooling chamber door 20R, and the second through hole 18 is provided with a second opening/closing damper 19 that is rotatably installed in the second through hole 18 and rotated by the connection tube 24, thereby opening the second through hole 18 when the connection tube 24 enters the second through hole 18. In the present embodiment, the second damper 19 is formed as a plate and the upper end of the second damper 19 is rotatably installed on the upper surface of the second through hole 18. In addition, a lower end portion of a front end of the connection tube 24 is inclined while protruding toward the second through hole 18 so as to gradually rotate the second damper 19.

In addition, the connection tube 24 is provided with a first opening/closing damper 25 by which the connection tube 24 is closed when the cooling chamber 11R is closed by the cooling chamber door 20R, so that the cooling air of the ice making chamber 21 is prevented from leaking through the connection tube 24. The first damper 25 is formed as a plate and the upper end of the first damper 25 is rotatably installed on the upper surface of the inner part of the connection tube 24, so that the connection tube 24 can be opened when the cooling chamber 11R is closed by the cooling chamber door 20R. Therefore, in order to allow the connection tube 24 to be opened when the cooling chamber 11R is closed by the cooling chamber door 20R, the connection tube 24 is provided at an external side thereof with a guide bar 26 having a predetermined length, in which the upper end of the guide bar 26 is coupled to the first open/close damper 25 disposed in the connection tube 24 so as to rotate together with first open/close damper 25. In addition, the second through hole 18 is provided at the sidewall thereof with a guide protrusion 18*a* that guides the guide bar 26 to rotate the guide bar 26. In the present embodiment, the lower end of the guide protrusion 18*a* facing the connection tube 24 is inclined while protruding toward the connection tube 24 so as to gradually rotate the guide bar 26.

Figure 3:
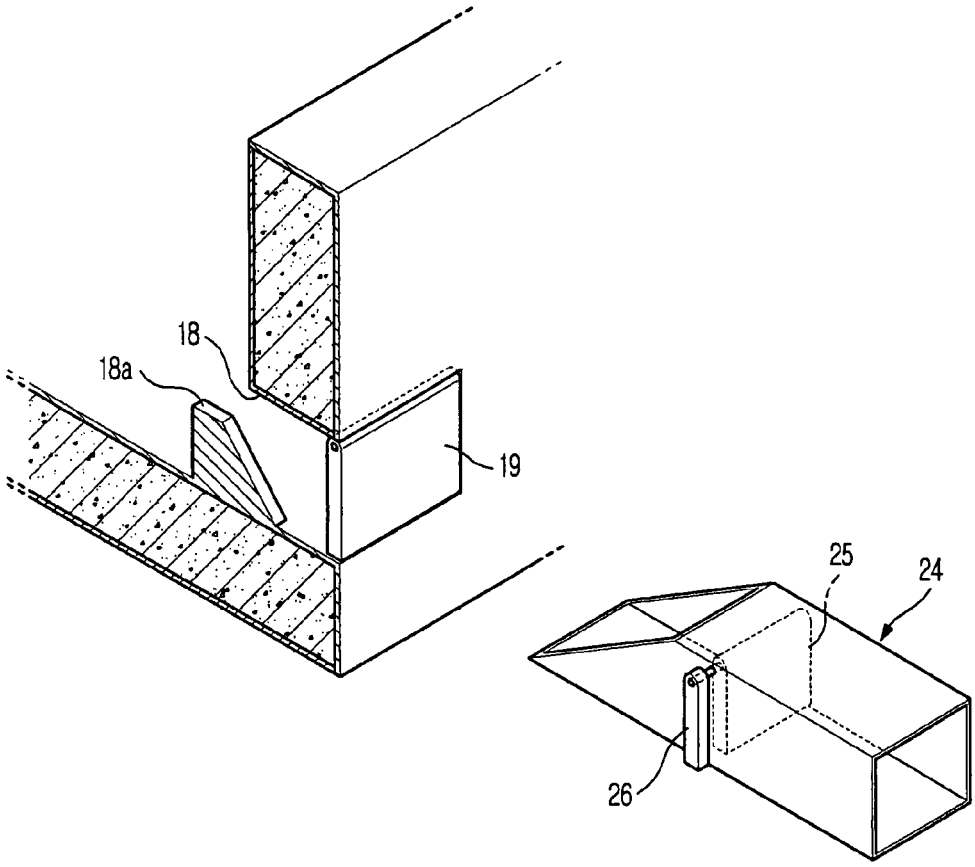
FIGS. 3 and 4 are sectional views illustrating operations of a first open/close damper and a second open/close damper that are applied to the refrigerator according to the embodiment of the present invention.
Figure 4:
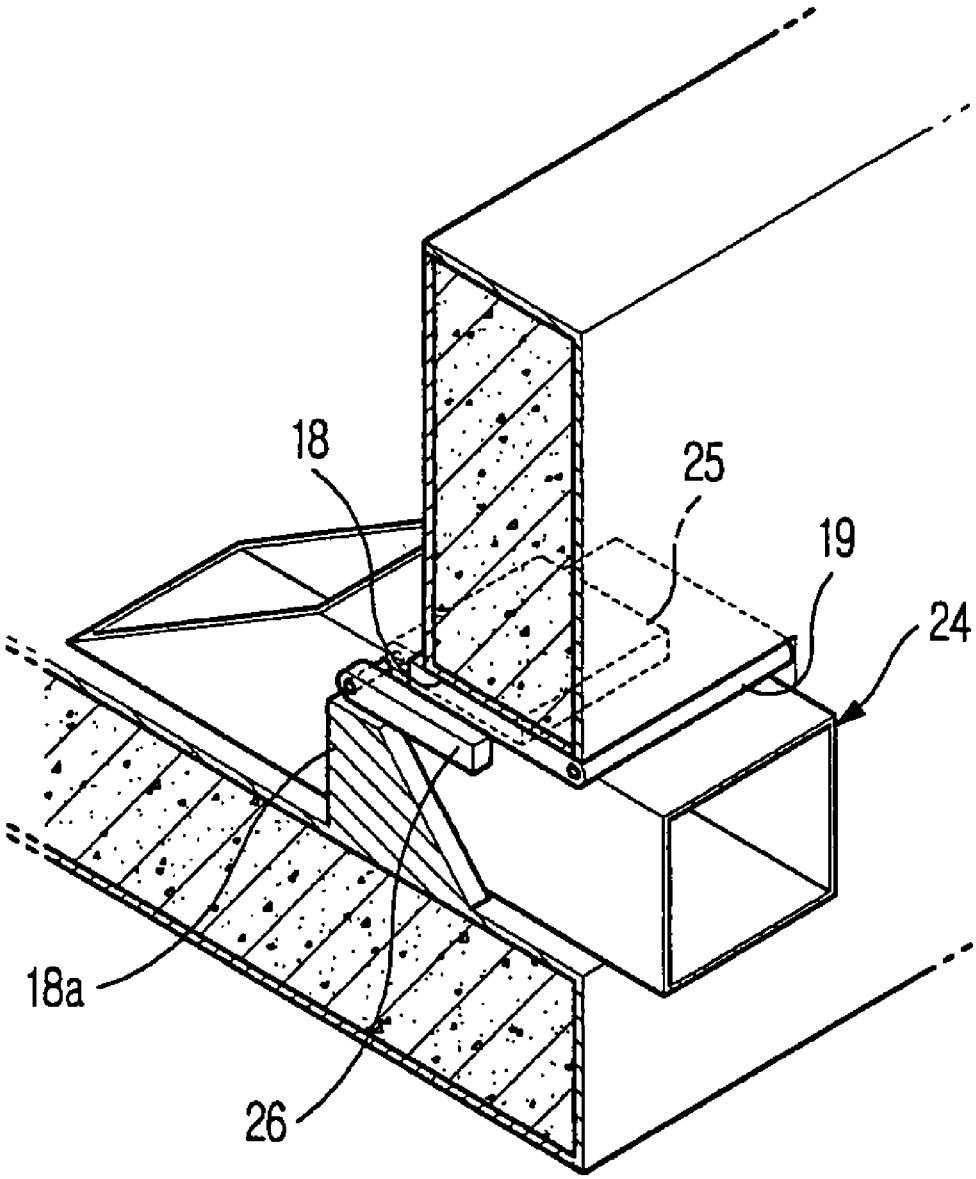

Therefore, as illustrated in FIG. 3, in a state in which the cooling chamber 11R is opened according to the opening of the cooling chamber door 20R, the first through holes 23 and second through holes 18 are closed by the first open/close damper 25 and the second open/close damper 19, thereby preventing the cooling air from leaking through the first through holes 23 and second through holes 18. Also, as illustrated in FIG. 4, in a state in which the cooling chamber 11R is closed according to the closing of the cooling chamber door 20R, the connection tube 24 provided in the first through hole 23 enters the second through hole 18 so as to rotate the second open/close damper 19, thereby opening the second through hole 18.

In this manner, the guide bar 26 is guided and rotated by an inclined surface of the guide protrusion 18*a* while the connection tube 24 is entering the second through hole 18, so that the first damper 25 coupled to the guide bar 26 is rotated together with the guide bar 26, thereby opening the connection tube 24. Thus, the cooling air can circulate into the ice making chamber 21 and the ice making evaporator chamber 17 through the first through holes 23 and the second through holes 18.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body having a cooling chamber defined therein;

a cooling chamber door opening/closing the cooling chamber;

an ice making apparatus making ice;

an ice making evaporator supplying the ice making apparatus with cooling air;

an ice making chamber defined in the cooling chamber door to receive the ice making apparatus therein; and an ice making evaporator chamber provided at one side of the cooling chamber to install the ice making evaporator therein while being partitioned from the cooling chamber, wherein the ice making chamber comprises a pair of first through holes, and a first damper and a first opening unit being respectively provided in each of the first through holes, the ice making evaporator chamber comprises a pair of second through holes disposed corresponding to the first through holes, and a second damper and a second opening unit being respectively provided in each of the second through holes, when the cooling chamber has been closed by the cooling chamber door, the first dampers being respectively opened by the second opening units and the second dampers being respectively opened by the first opening units so that the pairs of the first and second through holes communicate with each other, and the first and second dampers being closed when the cooling chamber has been opened by the cooling chamber door.

2. The refrigerator as claimed in claim 1, further comprising a connection tube, wherein one of the first through holes is provided with the connection tube that enters a corresponding one of the second through holes when the cooling chamber is closed by the cooling chamber door, and the connection tube being removed from the corresponding one of the second through holes when the cooling chamber is opened by the cooling chamber door.

3. The refrigerator as claimed in claim 2, wherein the connection tube is provided with the first damper rotatably installed in the connection tube to open the connection tube when the cooling chamber is closed by the cooling chamber door.

4. The refrigerator as claimed in claim 2, further comprising an ice making circulation fan, wherein the ice making chamber is provided with the ice making circulation fan to generate a suction force and a blowing force such that the cooling air is circulated into the ice making chamber and the ice making evaporator chamber through the first through hole provided with the connection tube and the second through hole.

5. The refrigerator as claimed in claim 1, wherein the cooling chamber door is provided with a dispenser that allows a user to take out the ice made by the ice making apparatus.

6. A refrigerator comprising:

a body having a cooling chamber defined therein;

a cooling chamber door opening/closing the cooling chamber;

an ice making apparatus making ice;

an ice making evaporator supplying the ice making apparatus with cooling air;

an ice making chamber defined in the cooling chamber door to receive the ice making apparatus therein;

an ice making evaporator chamber provided at one side of the cooling chamber to install the ice making evaporator therein while being partitioned from the cooling chamber and communicating with the ice making chamber when the cooling chamber has been closed by the cooling chamber door;

a pair of first through holes and a pair of second through holes, wherein the ice making chamber is provided at both sides thereof with the pair of first through holes communicating with the ice making evaporator chamber, and the ice making evaporator chamber is provided with the pair of second through holes disposed corresponding to the first through holes to communicate with the first through holes when the cooling chamber has been closed by the cooling chamber door;

a connection tube, wherein one of the first through holes is provided with the connection tube that enters the second through hole when the cooling chamber is closed by the cooling chamber door;

a first damper, wherein the connection tube is provided with the first damper rotatably installed in the connection tube to open the connection tube when the cooling chamber is closed by the cooling chamber door; and a guide bar and a guide protrusion, wherein an external side of the connection tube is provided with the guide bar having a predetermined length, in which one end of the guide bar is coupled to the first damper to be rotated together with the first damper, and one side of the second through hole is provided with the guide protrusion protruding toward the connection tube to rotate the guide bar when the connection tube enters the second through hole.

7. The refrigerator as claimed in claim 6, wherein the guide bar is inclined.

8. A refrigerator comprising:

a body having a cooling chamber defined therein;

a cooling chamber door opening/closing the cooling chamber;

an ice making apparatus making ice;

an ice making evaporator supplying the ice making apparatus with cooling air;

an ice making chamber defined in the cooling chamber door to receive the ice making apparatus therein;

an ice making evaporator chamber provided at one side of the cooling chamber to install the ice making evaporator therein while being partitioned from the cooling chamber, wherein the ice making chamber comprises a pair of first through holes, the ice making evaporator chamber comprises a pair of second through holes disposed corresponding to the first through holes, and the pairs of the first and second through holes communicate with each other when the cooling chamber has been closed by the cooling chamber door and are closed, respectively, when the cooling chamber has been opened by the cooling chamber door;

a connection tube, wherein one of the first through holes is provided with the connection tube that enters a corresponding one of the second through holes when the cooling chamber is closed by the cooling chamber door; and a second damper, wherein the corresponding second through hole is provided with the second damper that is rotatably installed in the corresponding second through hole to open the second through hole when the connection tube enters the corresponding second through hole.

9. The refrigerator as claimed in claim 8, wherein an upper end portion of the second damper is rotatably provided on an upper surface of the corresponding second through hole, and the connection tube is inclined so that a front lower portion of the connection tube protrudes toward the corresponding second through hole.

10. A refrigerator comprising:

a body having a cooling chamber therein;

a cooling chamber door opening/closing the cooling chamber;

an ice making chamber;

an ice making apparatus installed at the cooling chamber door to make ice;

an ice making evaporator that independently supplies the ice making apparatus with cooling air; and wherein the ice making chamber comprises a pair of first through holes, and a first damper and a first opening unit being respectively provided in each of the first through holes, the ice making evaporator chamber comprises a pair of second through holes disposed corresponding to the first through holes, and a second damper and a second opening unit being respectively provided in each of the second through holes, when the cooling chamber has been closed by the cooling chamber door, the first dampers being respectively opened by the second opening units and the second dampers being respectively opened by the first opening units so that the pairs of the first and second through holes communicate with each other, and the first and second dampers being closed, respectively, when the cooling chamber has been opened by the cooling chamber door.

11. The refrigerator as claimed in claim 10, further comprising a dispenser, wherein the cooling chamber door is provided with the dispenser to allow a user to take out the ice.

12. A refrigerator comprising:

a body having a cooling chamber therein;

a cooling chamber door opening/closing the cooling chamber;

an ice making chamber;

an ice making apparatus installed at the cooling chamber door to make ice; and an ice making evaporator having an ice making evaporator that independently supplies the ice making apparatus with cooling air; and wherein the ice making chamber comprises a pair of first through holes, the ice making evaporator chamber comprises a pair of second through holes disposed corresponding to the first through holes, and the pairs of the first and second through holes communicate with each other when the cooling chamber has been closed by the cooling chamber door and are closed, respectively, when the cooling chamber has been opened by the cooling chamber door, wherein the cooling chamber door is provided with the ice making chamber in which the ice making apparatus is installed and wherein the body is provided with the ice making evaporator chamber, which is disposed at an upper front side of the cooling chamber while being partitioned from the cooling chamber and communicating with the ice making chamber.

13. The refrigerator as claimed in claim 12, further comprising a connection tube, wherein one of the first through holes is provided with the connection tube that enters one of the second through holes when the cooling chamber is closed by the cooling chamber door.

14. The refrigerator as claimed in claim 13, further comprising a first damper, wherein the connection tube is provided with the first damper rotatably installed in the connection tube to open the connection tube when the cooling chamber is closed by the cooling chamber door.

15. The refrigerator as claimed in claim 13, further comprising a second damper, wherein one of the second through holes is provided with the second damper that is rotatably installed in the second through hole to open the second through hole when the connection tube enters the one of the second through holes.

16. The refrigerator as claimed in claim 15, wherein an upper end portion of the second damper is rotatably provided on an upper surface of the second through hole, and the connection tube is inclined in such a manner that a front lower portion of the connection tube protrudes toward the one of the second through holes.

17. The refrigerator as claimed in claim 12, further comprising an ice making circulation fan, wherein the ice making chamber is provided with the ice making circulation fan to generate suction force and a blowing force such that the cooling air is circulated into the ice making chamber and the ice making evaporator chamber through one of the first through holes and the second through holes.

18. A refrigerator comprising:

a body having a cooling chamber therein;

a cooling chamber door opening/closing the cooling chamber;

an ice making apparatus installed at the cooling chamber door to make ice;

an ice making evaporator that independently supplies the ice making apparatus with cooling air;

an ice making chamber, wherein the cooling chamber door is provided with the ice making chamber in which the ice making apparatus is installed;

an ice making evaporator chamber, wherein the body is provided with the ice making evaporator chamber, which is disposed at an upper front side of the cooling chamber while being partitioned from the cooling chamber and communicating with the ice making chamber, wherein the ice making chamber is provided at both sides thereof with a pair of first through holes communicating with the ice making evaporator chamber, and the ice making evaporator chamber is provided with a pair of second through holes disposed corresponding to the first through holes and communicated with the first through holes when the cooling chamber has been closed by the cooling chamber door;

a connection tube, wherein one of the first through holes is provided with the connection tube that enters one of the second through holes when the cooling chamber is closed by the cooling chamber door;

a first damper, wherein the connection tube is provided with the first damper rotatably installed in the connection tube to open the connection tube when the cooling chamber is closed by the cooling chamber door; and a guide bar, and a guide protrusion, wherein an external side of the connection tube is provided with the guide bar having a predetermined length, in which one end of the guide bar is coupled to the first damper to be rotated together with the first damper, and one side of the second through hole is provided with the guide protrusion protruding toward the connection tube to rotate the guide bar when the connection tube enters the second through hole.

19. A refrigerator comprising:

a cooling chamber;

a cooling chamber door opening/closing the cooling chamber, an ice making chamber being defined in the cooling chamber door;

an ice making apparatus in the ice making chamber; and an ice making evaporator chamber in the cooling chamber, wherein the ice making chamber comprises a pair of first through holes, and a first damper and a first opening unit being respectively provided in each of the first through holes, the ice making evaporator chamber comprises a pair of second through holes disposed corresponding to the first through holes, and a second damper and a second opening unit being respectively provided in each of the second through holes, when the cooling chamber has been closed by the cooling chamber door, the first dampers being respectively opened by the second opening units and the second dampers being respectively opened by the first opening units so that the pairs of the first and second through holes communicate with each other, and the first and second dampers being closed, respectively, when the cooling chamber has been opened by the cooling chamber door.

20. A refrigerator comprising:

a body which forms an external appearance of the refrigerator;

an inner shell defining a freezer compartment and a refrigerator compartment disposed above the freezer compartment;

an insulation disposed between the inner shell and the body;

a refrigerator door to open and close the refrigerator compartment;

a freezer door to open and close the freezer compartment;

an evaporator to supply cold air;

a compressor to compress refrigerant which is supplied to the evaporator;

a cold-air-receiving chamber unit provided at a rear section of the refrigerator door;

a cold-air-supplying chamber unit provided at a ceiling section of the refrigerator compartment, an ice storage unit disposed in the cold-air-receiving chamber unit to store ice; and a dispenser to dispense the ice from the ice storage unit without opening the refrigerator door, wherein the cold-air-supplying chamber unit supplies the cold air received from the evaporator to the cold-air-receiving chamber unit, when the refrigerator door is in a closed position, wherein the cold-air-supplying chamber unit is adapted to automatically prohibit the cold air received from the evaporator from flowing out of the cold-air-supplying chamber unit when the refrigerator door is opened, wherein the cold-air-receiving chamber unit includes a first wall having a first opening, and the cold-air-supplying chamber unit includes a second wall extending downward from the ceiling section of the refrigerator, a second opening formed through the second wall which is positioned to coincide with the first opening of the cold-air-receiving chamber unit when the refrigerator door is in the closed position to provide an air passageway through which the cold air from the cold-air-supplying chamber unit is supplied to the cold-air-receiving chamber unit, wherein the first opening is formed between a top edge and a bottom edge of the first wall and the second opening is formed between a top edge and a bottom edge of the second wall such that the first and second walls define adjacent planes when the refrigerator door is in the closed position, further comprising:

a damper movably installed at the second opening to automatically close the second opening when the refrigerator door is in an open position and to automatically open the second opening when the refrigerator door is in the closed position, wherein the damper is pivotably mounted to rotate about a horizontal axis that is substantially perpendicular to a rotational axis of the refrigerator door, the horizontal axis of the damper being positioned at an upper region of the second opening such that a free end of the damper moves in an upward direction to automatically open the second opening when the refrigerator door moves from the open position to the closed position and the free end of the damper moves in a downward direction to automatically close the second opening when the refrigerator door moves from the closed position to the open position, further comprising a protruding member extending from the first opening to prohibit air leakage between the first opening and the second opening when the refrigerator door is in the closed position.

21. The refrigerator as claimed in claim 20, wherein the protruding member comprises a connection tube that enters the second opening when the refrigerator door is in the closed position.

22. A refrigerator comprising:

a body which forms an external appearance of the refrigerator;

an inner shell defining a freezer compartment and a refrigerator compartment disposed above the freezer compartment;

an insulation disposed between the inner shell and the body;

a refrigerator door to open and close the refrigerator compartment;

a freezer door to open and close the freezer compartment;

an evaporator to supply cold air;

a compressor to compress refrigerant which is supplied to the evaporator;

a cold-air-receiving chamber unit provided at a rear section of the refrigerator door;

a cold-air-supplying chamber unit provided at a ceiling section of the refrigerator compartment, an ice storage unit disposed in the cold-air-receiving chamber unit to store ice; and a dispenser to dispense the ice from the ice storage unit without opening the refrigerator door, wherein the cold-air-supplying chamber unit supplies the cold air received from the evaporator to the cold-air-receiving chamber unit, when the refrigerator door is in a closed position, wherein the cold-air-supplying chamber unit is adapted to automatically prohibit the cold air received from the evaporator from flowing out of the cold-air-supplying chamber unit when the refrigerator door is opened, wherein the cold-air-receiving chamber unit includes a first wall having a first opening, and the cold-air-supplying chamber unit includes a second wall extending downward from the ceiling section of the refrigerator, a second opening formed through the second wall which is positioned to coincide with the first opening of the cold-air-receiving chamber unit when the refrigerator door is in the closed position to provide an air passageway through which the cold air from the cold-air-supplying chamber unit is supplied to the cold-air-receiving chamber unit, wherein the first opening is formed between a top edge and a bottom edge of the first wall and the second opening is formed between a top edge and a bottom edge of the second wall such that the first and second walls define adjacent planes when the refrigerator door is in the closed position, further comprising:

a damper movably installed at the second opening to automatically close the second opening when the refrigerator door is in an open position and to automatically open the second opening when the refriqerator door is in the closed position, wherein the damper is pivotably mounted to rotate about a horizontal axis that is substantially perpendicular to a rotational axis of the refrigerator door, the horizontal axis of the damper being positioned at an upper region of the second opening such that a free end of the damper moves in an upward direction to automatically open the second opening when the refrigerator door moves from the open position to the closed position and the free end of the damper moves in a downward direction to automatically close the second opening when the refrigerator door moves from the closed position to the open position, wherein a width of the cold-air-receiving chamber unit is substantially the same as a width of the cold-air-supplying chamber unit.

23. The refrigerator as claimed in claim 2, wherein the first opening is substantially rectangular shaped and the first wall completely surrounds all sides of the rectangular shaped first opening, and the second opening is substantially rectangular shaped and the second wall completely surrounds all sides of the rectangular shaped second opening.

24. The refrigerator as claimed in claim 22, wherein the evaporator comprises an ice making evaporator disposed in the cold-air-supplying chamber unit.

* * * * *

UNITED STATES PATENT AND TRADEMARK OFFICE

CERTIFICATE OF CORRECTION

PATENT NO. : 8,132,423 B2
APPLICATION NO. : 11/987581
DATED : March 13, 2012
INVENTOR(S) : Alexei Tikhonov et al.

It is certified that error appears in the above-identified patent and that said Letters Patent is hereby corrected as shown below:

Column 12, Line 14, in Claim 22, delete “refriqerator” and insert -- refrigerator --, therefor.

Column 12, Line 30, in Claim 23, delete “claim 2,” and insert -- claim 22, --, therefor.

Signed and Sealed this
Twenty-ninth Day of May, 2012

David J. Kappos

David J. Kappos
*Director of the United States Patent and Trademark Office*